US007044122B2

(12) United States Patent
Personnettaz et al.

(10) Patent No.: US 7,044,122 B2
(45) Date of Patent: May 16, 2006

(54) DIRECT CONVECTION OVEN

(75) Inventors: Laurent Personnettaz, Faverges (FR); Raymond Violi, Marlens (FR)

(73) Assignee: Societe Cooperative de Production, Villefranche sur Soane (FR)

( * ) Notice: Subject to any disclaimer, the term of this patent is extended or adjusted under 35 U.S.C. 154(b) by 131 days.

(21) Appl. No.: 10/485,184

(22) PCT Filed: Jul. 29, 2002

(86) PCT No.: PCT/FR02/02707

§ 371 (c)(1),
(2), (4) Date: Jan. 28, 2004

(87) PCT Pub. No.: WO03/012342

PCT Pub. Date: Feb. 13, 2003

(65) Prior Publication Data

US 2004/0216731 A1 Nov. 4, 2004

(30) Foreign Application Priority Data

Jul. 31, 2001 (FR) ..... 01 10415

(51) Int. Cl.
*A21B 1/02* (2006.01)
*F24C 15/32* (2006.01)

(52) U.S. Cl. ..... 126/21 A; 219/400

(58) Field of Classification Search ..... 126/21 A, 126/21 R, 19 R, 273 R, 299 E; 219/400, 219/399, 398
See application file for complete search history.

(56) References Cited

U.S. PATENT DOCUMENTS

| | | | | |
|---|---|---|---|---|
| 4,369,760 A | | 1/1983 | Jorgensen et al. | |
| 5,287,253 A | | 2/1994 | Blorstad | |
| 5,497,760 A | * | 3/1996 | Alden et al. | 126/21 A |
| 5,601,070 A | * | 2/1997 | Hotard et al. | 126/21 A |
| 5,655,511 A | * | 8/1997 | Prabhu et al. | 126/21 A |
| 6,114,664 A | | 9/2000 | Cook et al. | |

FOREIGN PATENT DOCUMENTS

| | | | |
|---|---|---|---|
| DE | 19730610 C | | 10/1998 |
| FR | 2 548 764 A1 | * | 1/1985 |

OTHER PUBLICATIONS

Internatinal Search Report dated Dec. 2, 2002, application No. PCT/FR02/02707.

* cited by examiner

*Primary Examiner*—Josiah C. Cocks
(74) *Attorney, Agent, or Firm*—RatnerPrestia

(57) ABSTRACT

The invention concerns an oven wherein a globally parallelepiped muffle chamber (1) contains a centrifugal convection turbine (9) driven by a motor (10) and arranged adjacent to the center of the rear peripheral wall (7). Annular electrical resistors (12, 13) are placed at the periphery of the turbine, the assembly being surrounded by a mechanical protection grid (22). The convection turbine (9) and the heating means (12, 13) are placed in the muffle chamber (1) communicating directly with the cooking volume (81), without separating wall countering the air flow. The oven is thus provided both with self-cleaning effect and a better cooking heat distribution in the oven.

10 Claims, 6 Drawing Sheets

DIRECT CONVECTION OVEN

This is a U.S. National Phase of International Application No. PCT/FR02/02707 filed Jul. 29, 2002.

TECHNICAL FIELD OF THE INVENTION

The present invention relates to ovens for cooking food, and more particularly convection ovens used in institutional kitchens.

Convection ovens for cooking food generally comprise a metal muffle surrounding an interior muffle cavity, with a lower wall forming a floor, an upper wall forming a ceiling, and four vertical peripheral walls. At least one of the peripheral walls is provided with an access door for introducing food to be cooked into the interior cavity of the muffle and extracting it therefrom.

In the interior space of the oven, i.e. in the interior cavity of the muffle, convection of air is achieved by a convection turbine that is driven in rotation by a motor and is generally disposed in the vicinity of one of the peripheral walls that has no access door. The turbine is mounted to rotate about a rotation axis perpendicular to the peripheral wall.

The document U.S. Pat. No. 4,369,760 A, for example, describes a portable fan for circulating air in an oven into which it is inserted. The fan, placed near the posterior wall of the oven, discharges air axially toward the front in the direction of the food to be cooked. There is no heating element placed in the flow of air, with the result that heat exchange is unsatisfactory. Also, the blades of the fan are not protected effectively.

Heating means can advantageously be placed in the flow of air, upstream or downstream of the turbine, and can be adapted to heat the air that is propelled into the muffle by the turbine, encouraging the cooking of the food.

In most prior art ovens, such as those described in the document U.S. Pat. No. 6,114,664A, the interior cavity of the muffle is divided into two compartments: a cooking compartment, accessible via the door, and conformed to receive the food to be cooked, and a heating compartment, containing the convection turbine and the heating means such as resistive electrical heating elements or gas burners. The cooking compartment is always isolated from the heating compartment by a box or by a separating wall that is generally perpendicular to the rotation axis of the turbine and comprises a few holes through which air can pass. The separating wall has a double effect of channeling the flow of air propelled by the turbine, and protecting the heating compartment from splashed grease and other materials from the food being cooked. In fact, in prior art ovens, a constant concern is preventing splashes from food being cooked soiling the members inside the heating compartment, namely the turbine, the heating means and sensors used to control these elements.

Despite the presence of the separating wall, manual cleaning operations are periodically required to guarantee that the oven is clean. Cleaning cannot be automated in the prior art oven structures, and necessitates demounting and remounting the separating wall.

Another problem that is encountered in gas ovens of this kind for cooking food is the difficulty of ensuring regular cooking of all the food in the oven, regardless of its position within the cooking compartment. It is found in fact that the cooking of the food can vary significantly as a function of the position of the food in the cooking compartment. Some areas of the cooking compartment can overheat the food, while other areas achieve insufficient heating. Also, the evenness of cooking is modified as a function of the type of food to be cooked, and as a function of the quantities of food introduced into the cooking compartment.

SUMMARY OF THE INVENTION

One object of the present invention is namely to avoid the drawbacks of prior art structures of convection ovens for cooking food, with the aim of assisting cleaning or self-cleaning of the oven and achieving more even cooking.

The invention stems from the surprising observation that eliminating the separation wall between the cooking compartment and the heating compartment, combined with a turbine rotation direction aspirating air axially to discharge it in the vicinity of the peripheral walls, achieves at one and the same time an effect of selfcleaning of the oven and more even cooking.

Accordingly, to achieve the above and other objects, the invention proposes a convection oven for cooking food, comprising:

- a muffle with a generally parallelepipedal interior cavity delimited by a lower floor wall, an upper ceiling wall and four peripheral walls, at least one of the peripheral walls being provided with an access door for entry of food to be cooked into the interior cavity of the muffle and its exit therefrom,
- a centrifugal convection turbine, driven in rotation by a motor, disposed in the interior cavity of the muffle in the vicinity of the center of an adjacent peripheral wall with no access door, mounted to rotate about a rotation axis perpendicular to the adjacent peripheral wall, and adapted to aspirate air axially toward the center of the adjacent peripheral wall and to discharge it radially toward the edges of the adjacent peripheral wall,
- heating means placed in the flow of air upstream or downstream of the convection turbine, and adapted to heat the air that is propelled into the muffle by the convection turbine to cook the food,
- a cooking volume, reserved in the interior cavity of the muffle to receive food to be cooked;

according to the invention, the convection turbine and the heating means are placed in the interior cavity of the muffle in direct communication with the cooking volume, with no separation wall opposing the circulation of air, with a mechanical protection grid conformed and interposed between the convection turbine and the cooking volume to prevent the contact of a user's hand with the blades of the rotating convection turbine.

It is found in particular that relatively cool air is aspirated from an enlarged axial aspiration area occupied by the food to be cooked, and that the warm air discharged is confined to the vicinity of the peripheral walls, away from the food to be cooked. This results in improved heat exchange between the heating means and the air, and more even heating of the peripheral walls. Direct contact between the air that is too hot and the food is prevented.

In a first embodiment, constituting an electric oven, the heating means comprise annular resistive electrical heating elements placed at the periphery of the convection turbine.

In another embodiment, constituting a gas oven, heating means comprise a gas burner placed axially in the aspiration inlet of the convection turbine, or placed radially at the periphery of the convection turbine.

The convection turbine can advantageously be a generally cylindrical structure, with a posterior flange carrying a plurality of short blades at the front and distributed around its periphery.

The diameter of the convection turbine can advantageously be greater than one third of the greater dimension of the adjacent peripheral wall.

Surprisingly, the inventors have found that more even cooking is still obtained, in the absence of any separation wall, if the turbine is driven in rotation in the reverse direction, i.e. in the direction in which the inclination of the blades would tend to push the air toward the axis of the turbine. Clearly upon reverse rotation a turbine with short blades still pushes air centrifugally, but to a reduced degree.

Thanks to the structure according to the invention, the speed of the turbine can be varied over a relatively wide speed range, for example from 700 to 1300 revolutions per minute, without overheating the heating elements such as resistive electrical heating elements, thanks to improved heat exchange with the air. This means that the convection can be modulated as a function of the nature of the food to be cooked, to improve the quality thereof.

Good circulation of air in the oven can be obtained by providing a removable shelf support frame, that can be passed through the door of the oven, and that consists of uprights connected by crossmembers to form an open parallelepipedal structure allowing free circulation of air and carrying lateral slideways perpendicular to the door to receive slidingly and support horizontal shelves on which food to be cooked can be placed.

The oven is very easy to clean, and it is found that food sprayed from the food to be cooked does not remain on the turbine or the heating means, and is evacuated immediately by the flow of air toward the lower floor wall. This results in selfcleaning of the oven.

Cleaning can be further improved by providing a cleaning device that sprays water into the muffle. To this end, a cup can be used and placed adjacent the center of the upper wall of the muffle and central water supply means to produce a flow of water toward the periphery of the cup and parallel to the upper wall.

Thanks to the absence of any separating wall, the cleaning device has an immediate cleaning action at one and the same time on the cooking compartment and on the turbine and the heating means.

BRIEF DESCRIPTION OF THE DRAWINGS

Other objects, features and advantages of the present invention will emerge from the following description of particular embodiments, which description is given with reference to the accompanying drawings, in which.

DESCRIPTION OF THE PREFERRED EMBODIMENTS

Figure 1:
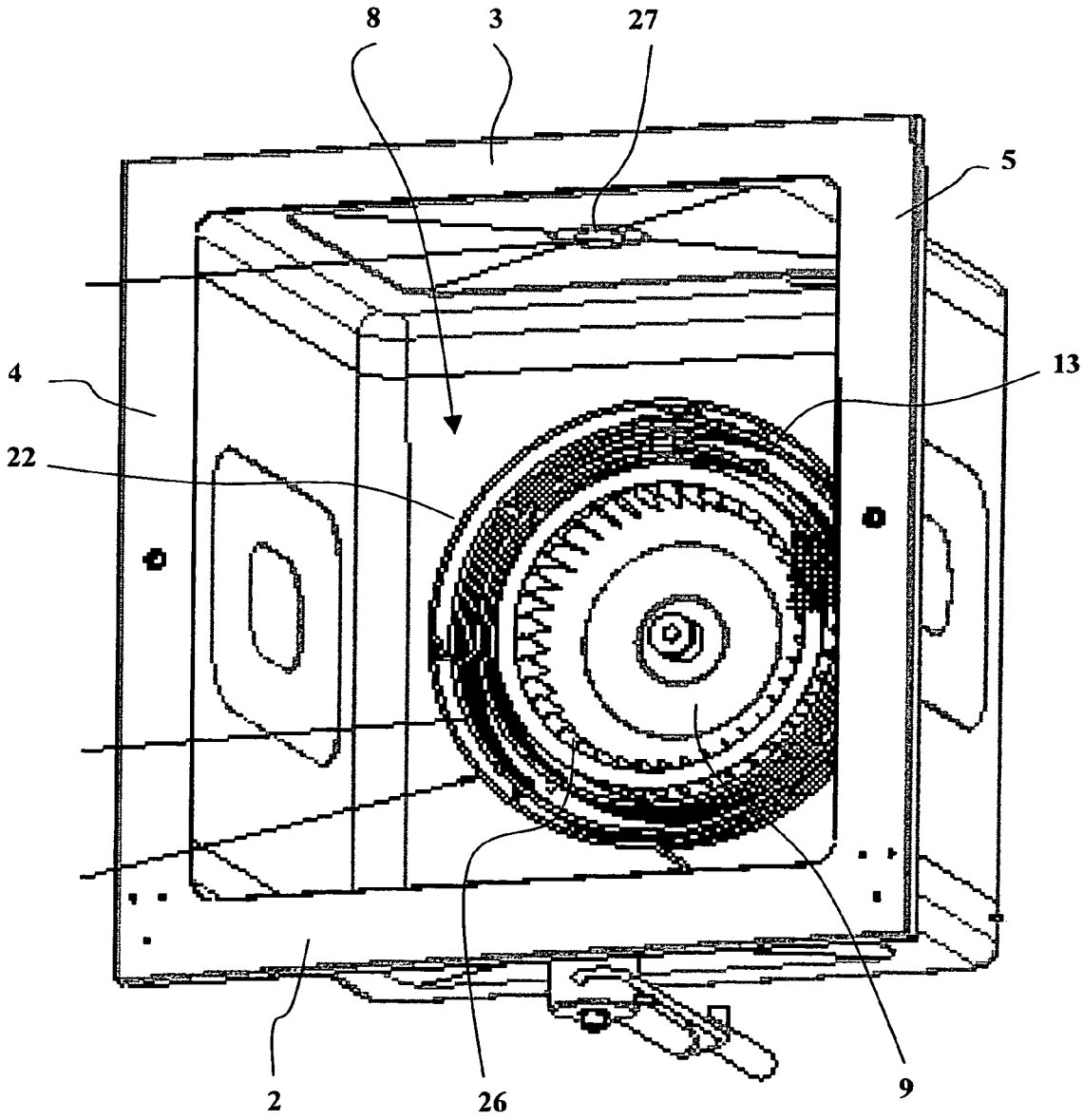
FIG. 1 is a perspective view of a first embodiment of an oven according to the invention, heated electrically.

In both embodiments, as depicted in the figures, a convection oven according to the invention comprises a muffle 1 having an interior cavity 8 of generally parallelepipedal shape delimited by a bottom floor wall 2, a top ceiling wall 3, two opposite lateral peripheral walls 4 and 5, an anterior peripheral wall 6 and a posterior peripheral wall 7.

In both the embodiments depicted, the anterior peripheral wall 6 is fitted with an access door for introducing food to be cooked into the interior cavity 8 of the muffle and extracting it therefrom.

The interior faces of the walls of the muffle are generally smooth, to prevent sticking and retention of food particles liable to be separated from food to be cooked.

A convection turbine 9 is driven in rotation by a motor 10 supplied with power by an external electrical power supply. The convection turbine 9 is of the centrifugal action type, aspirating air axially via its center and discharging air radially via its periphery. To this end it comprises inclined blades, in the usual manner known in the art. The convection turbine 9 is disposed in the vicinity of the center of a peripheral wall with no access door. In the embodiment shown, the convection turbine 9 is disposed in the vicinity of the center of the posterior peripheral wall 7 of the muffle.

Alternatively, in an embodiment that is not depicted in the figures, an oven can have two opposite doors respectively formed in the anterior peripheral wall 6 and in the posterior peripheral wall 7, with the turbine placed in the vicinity of one of the opposite lateral peripheral walls 4 and 5 of the oven.

The convection turbine 9 is mounted to rotate about a rotation axis 11 perpendicular to the posterior peripheral wall 7 to which it is adjacent.

Accordingly, the convection turbine 9 aspirates air axially toward the center of the posterior peripheral wall 7 and discharges air radially toward the edges of the posterior peripheral wall 7.

Heating means are placed in the flow of air upstream or downstream of the turbine, and are adapted to heat the air that is propelled into the muffle by the convection turbine 9.

Figure 2:
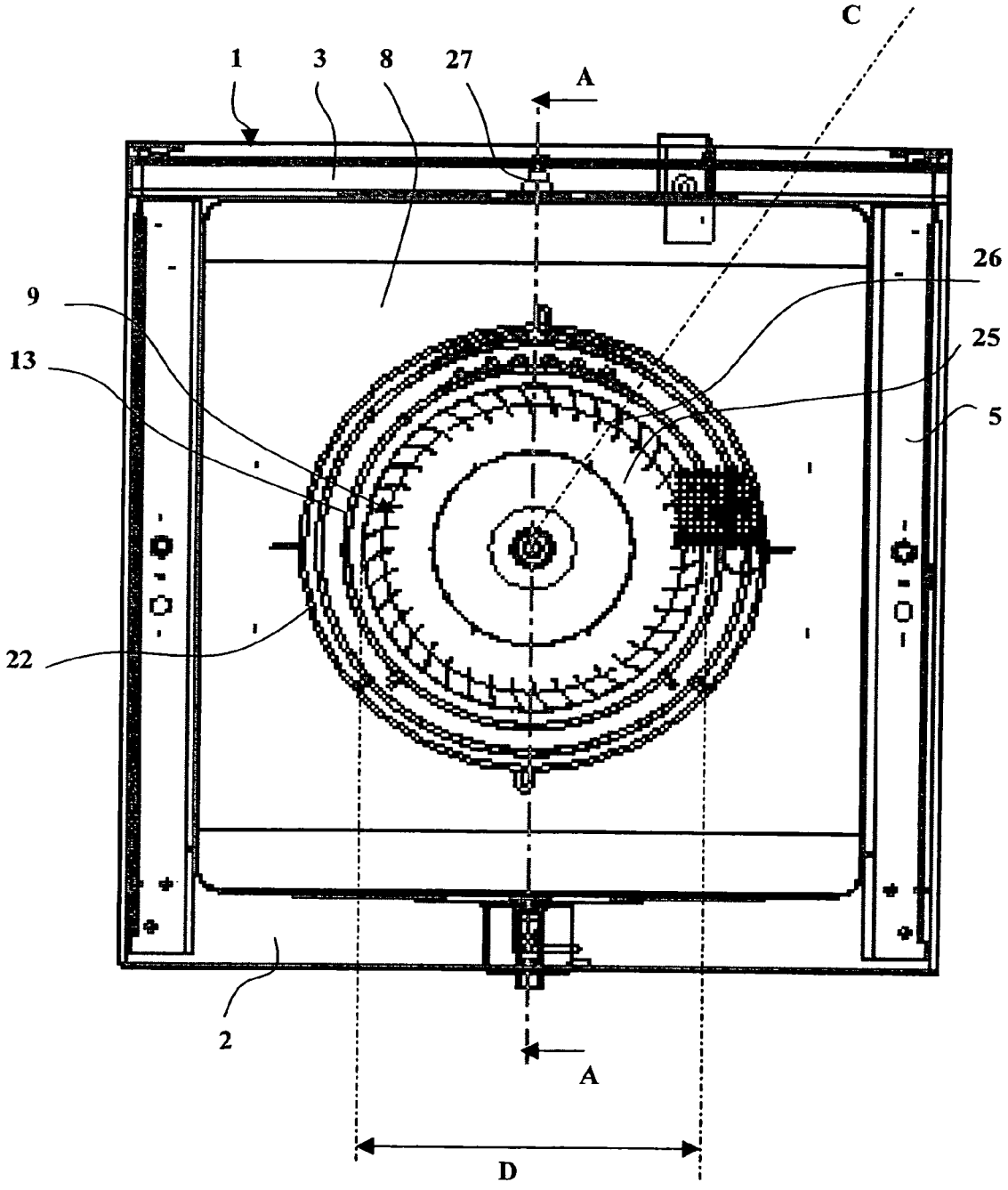
FIG. 2 is a front view of the FIG. 1 oven.
Figure 3:
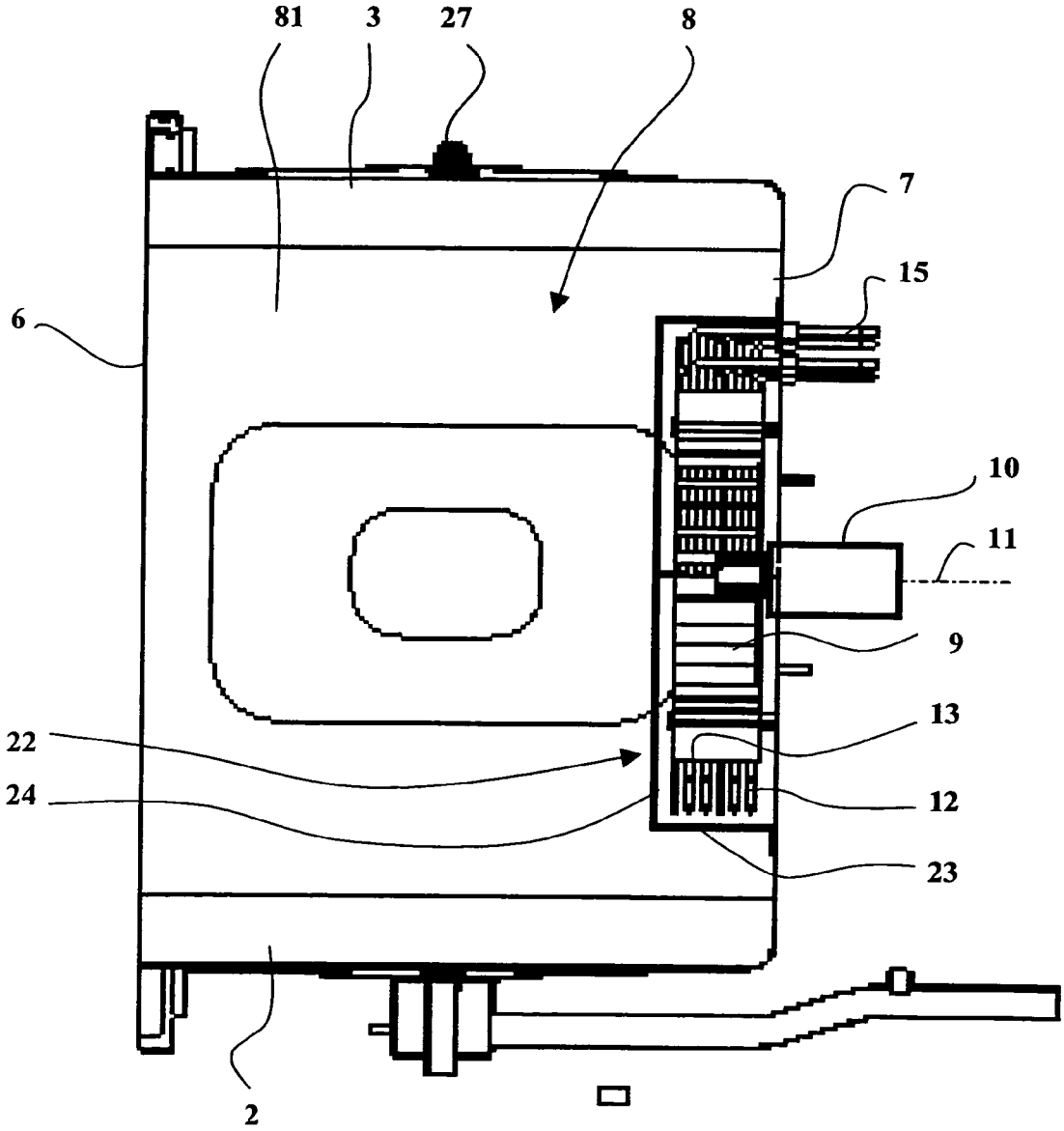
FIG. 3 is a right-hand side view of the FIG. 1 oven, in section taken along the line A—A.

In the embodiment depicted in FIGS. 1 to 3, the heating means comprise annular resistive electrical heating elements 12 and 13, placed at the periphery of the convection turbine 9, and supplied with power by an external electrical power supply to which they are connected by power supply conductors 15. The annular resistive electrical heating elements 12 and 13 are therefore placed in the flow of air downstream of the convection turbine 9.

Figure 4:
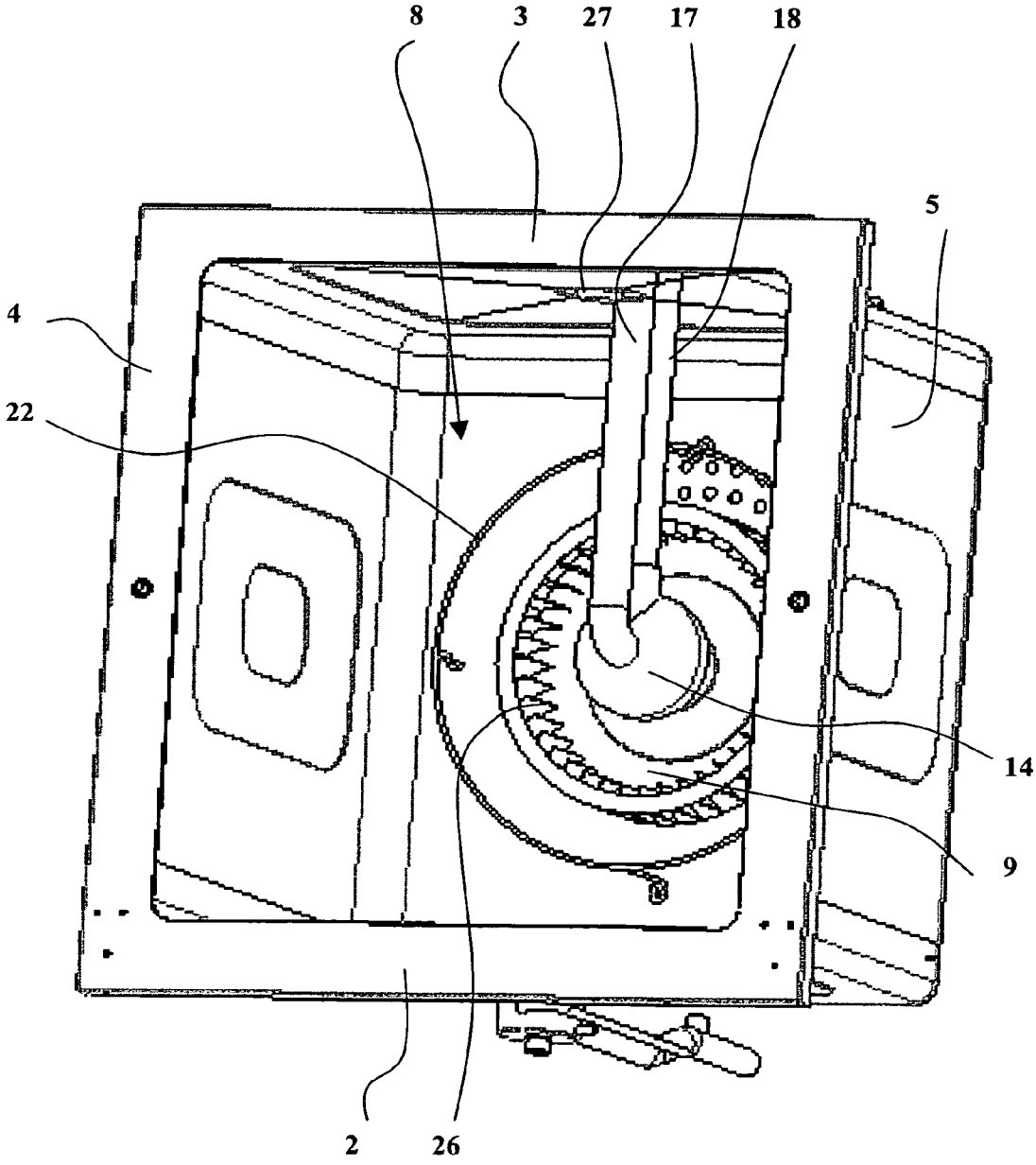
FIG. 4 is a perspective view of a second embodiment of an oven according to the invention, heated by gas.
Figure 5:
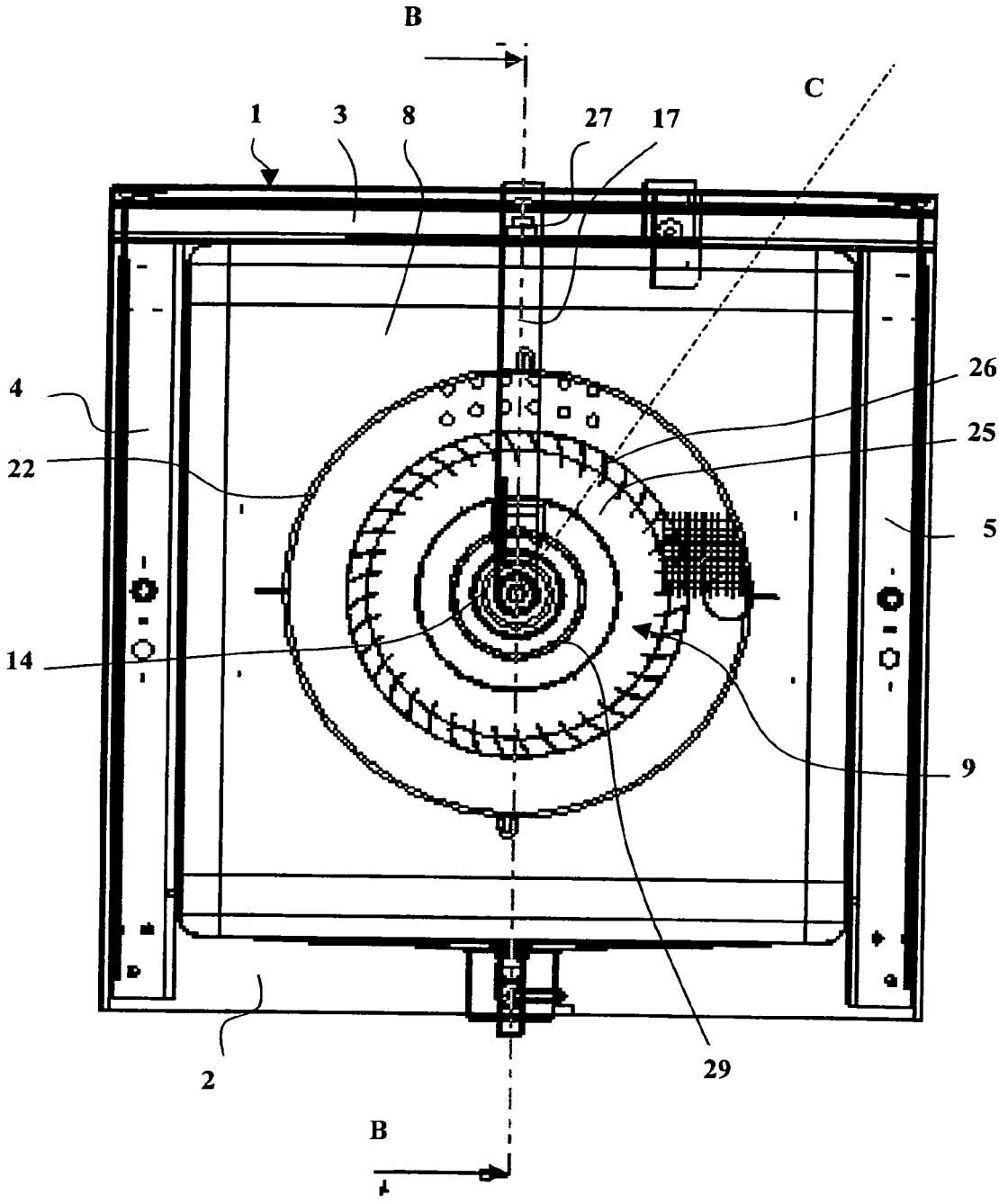
FIG. 5 is a front view of the FIG. 1 oven.
Figure 6:
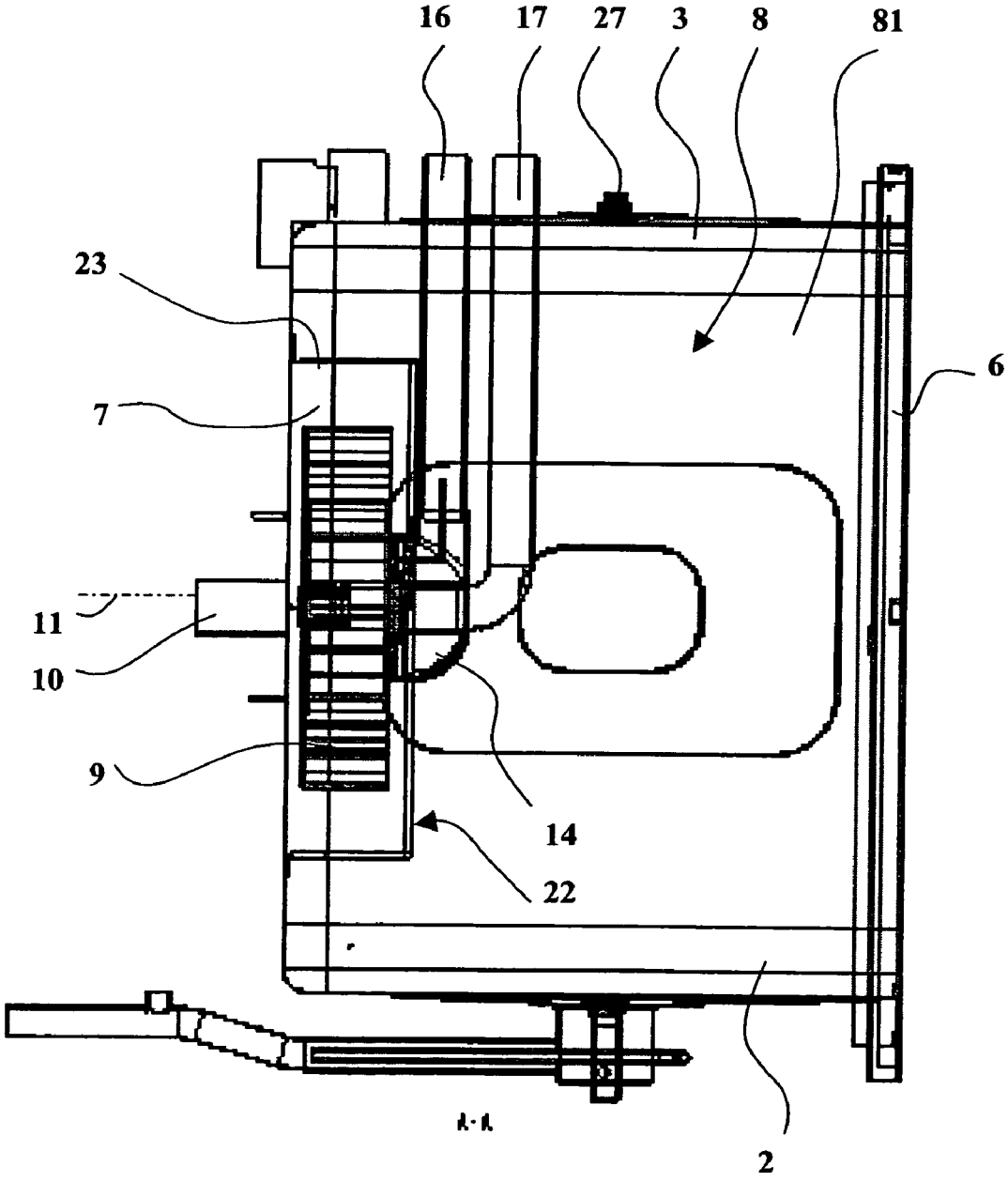
FIG. 6 is a left-hand side view of the FIG. 1 oven, in section taken along the line B—B.

In the embodiment depicted in FIGS. 4 to 6, the heating means comprise a gas burner 14 placed axially in the aspiration inlet of the convection turbine 9. The other components from the embodiment shown in FIGS. 1 to 3 are depicted again, and identified by the same reference numbers. The gas burner 14 is directed toward the posterior wall 7 of the oven, i.e. toward the center of the turbine 9. It is supplied via a supply pipe 16. A pipe 17 for evacuating burned gases passes through its central portion.

Means for receiving the food to be cooked are also provided inside the muffle 1. In the embodiments depicted in the figures, a cooking volume 81 is reserved inside the interior cavity 8 of the muffle to receive food to be cooked, and a removable simple frame is provided to support shelves, adapted to enter the muffle through the door provided in the anterior peripheral wall 6. The shelf support frame comprises uprights connected by top crossmembers to constitute an open and generally parallelepipedal structure allowing free circulation of air inside the oven. The shelf support frame structure carries lateral slideways, for example in the form of U-shaped profiles, perpendicular to the anterior peripheral wall 6, and conformed to receive sliding fashion and to support the lateral edges of horizontal shelves on which food to be cooked can be placed.

The convection turbine 9 and the heating means 12, 13 or 14 are placed in the muffle 1 in direct communication with the cooking volume 81, with no separating wall opposing the flow of air. There is merely provided a mechanical protection grid 22, which is conformed and interposed between the cooking volume 81 and the combination of the convection turbine 9 and the heating means 12, 13 or 14, to prevent mechanical contact of a user's hand with the blades of the rotating turbine or with the heating means. The mechanical protection grid 22 is of closed and enveloping cylindrical shape, with a cylindrical peripheral portion 23 and a plane front portion 24. The mechanical protection grid 22 has mesh size that is sufficiently large not to impede the flow of air toward or away from the convection turbine 9 and sufficiently small for a user's fingers not to pass through them. The mesh size can for example be chosen from a range of values from approximately 2×2 mm to 8×8 mm. A mesh of approximately 4×4 mm can advantageously be chosen.

In the embodiment shown in FIGS. 4 to 6, using a gas burner 14, the central region of the front portion 24 of the mechanical protection grid 22 carries a filter 29 or a grid of finer mesh, encouraging a regular flow of air around the gas burner 14 to stabilize the flame.

Clearly, in the oven structure as defined above, the air discharged radially by the convection turbine 9 is guided only by the peripheral walls of the muffle 1, and is distributed more freely throughout the cooking volume 81. This achieves more even cooking.

Simultaneously, there is nothing to oppose the free movement of splashed food particles that come from the food to be cooked in the cooking volume 81 and that can propagate into the whole of the interior cavity 8 of the muffle 1, and especially toward the convection turbine 9 and the heating means 12, 13 and 14. However, the free flow of air produces an effect of self-cleaning of the oven, and the particles do not remain in the area occupied by the convection turbine 9 and the heating means 12, 13 and 14.

To assure good convection of air, a convection turbine 9 with a generally cylindrical structure can advantageously be used, with a posterior flange 25 in the shape of a disc carrying a plurality of short blades 26 at the front and distributed around its periphery. The diameter D of the convection turbine 9 is preferably more than one third of the larger dimension (width or height) of the adjacent posterior peripheral wall 7.

In the embodiment depicted, the convection turbine 9 has at least twelve blades 26 at the front that have a radial dimension less than one tenth of its diameter D.

Improved cooking can be achieved by causing the convection turbine to rotate in the reverse direction, thereby reducing the centrifugal thrust that the convection turbine 9 exerts on the air. The reverse direction is defined relative to the orientation of the blades 26: in FIGS. 2 and 5, it can be seen that the blades 26 are inclined to the left relative to their corresponding radial direction C; by virtue of this orientation, the blades are efficient at pushing the air centrifugally when the turbine turns clockwise; in this case the reverse direction is the counterclockwise direction.

The embodiments depicted further comprise a cleaning device 27 that sprays water into the muffle 1.

The cleaning device 27 can comprise a horizontal cup adjacent the center of the upper ceiling wall 3, with central water supply means to produce a flow of water toward the periphery of the cup parallel to the upper ceiling wall 3. The water is sprayed radially at the periphery of the cup, preferably when the oven is still relatively warm, and the water then flows over all of the peripheral walls of the oven as well as over the convection turbine 9 and the heating means.

The particular structure of the oven according to the invention also enables correct operation as a combination oven, i.e. with steam in the cooking enclosure generated by an integrated steam generator.

The present invention is not limited to the embodiments that have been described explicitly, but includes variants and generalizations thereof within the scope of the following claims.

The invention claimed is:

1. Convection oven for cooking food, comprising:

a muffle with a generally parallelepipedal interior cavity delimited by a lower floor wall, an upper ceiling wall and four peripheral walls, at least one of the peripheral walls being provided with an access door for entry of food to be cooked into the interior cavity of the muffle and its exit therefrom, convection means, driven in rotation by a motor, disposed in the interior cavity of the muffle in the vicinity of the center of an adjacent peripheral wall with no access door, mounted to rotate about a rotation axis perpendicular to the adjacent peripheral wall, and adapted to cause air to circulate in the interior cavity of the muffle, heating means placed in the flow of air upstream or downstream of the convection means, and adapted to heat the air that is propelled into the muffle by the convection means to cook the food, a cooking volume, reserved in the interior cavity of the muffle to receive food to be cooked, wherein:

the convection means comprise a centrifugal convection turbine adapted to aspirate air axially toward the center of the adjacent peripheral wall and to discharge it radially toward the edges of the adjacent peripheral wall, the convection turbine and the heating means are placed in the interior cavity of the muffle in direct communication with the cooking volume with no separating wall opposing the circulation of air between the convection turbine and the cooking volume, with no separating wall opposing the circulation of air between the heating means and the cooking volume, with a mechanical protection grid conformed and interposed between the convection turbine and the cooking volume to prevent the contact of a user's hand with the blades of the rotating convection turbine.

2. Oven according to claim 1, wherein the heating means comprise annular resistive electrical heating elements placed at the periphery of the convection turbine.

3. Oven according to claim 1, wherein the heating means comprise a gas burner placed axially in the aspiration inlet of the convection turbine, or placed radially at the periphery of the convection turbine.

4. Oven according to claim 1, wherein the convection turbine is a generally cylindrical structure, with a posterior flange carrying a plurality of short blades at the front and distributed around its periphery.

5. Oven according to claim 4, wherein the diameter of the convection turbine is greater than one third of the greater dimension of the adjacent peripheral wall.

6. Oven according to claim 4, wherein the convection turbine comprises at least twelve blades having a radial dimension less than one tenth of its diameter.

7. Oven according to claim 1, wherein the convection turbine is driven in rotation in the reverse direction, thereby reducing the centrifugal push that it exerts on the air.

8. Oven according to claim 1, comprising a shelf support frame made up of uprights connected by upper crossmembers to form an open parallelepipedal structure allowing free circulation of air and carrying lateral slideways perpendicular to the anterior peripheral wall to receive slidingly and support the lateral edges of horizontal shelves on which the food to be cooked can be placed.

9. Oven according to claim 1, comprising a cleaning device for spraying water into the muffle.

10. Oven according to claim 9, wherein the cleaning device comprises a horizontal cup adjacent the center of the upper ceiling wall and central water supply means for producing a flow of water toward the periphery of the cup parallel to the upper ceiling wall.

* * * * *

UNITED STATES PATENT AND TRADEMARK OFFICE

CERTIFICATE OF CORRECTION

PATENT NO. : 7,044,122 B2
APPLICATION NO. : 10/485184
DATED : May 16, 2006
INVENTOR(S) : Laurent Personnettaz and Raymond Violi It is certified that error appears in the above-identified patent and that said Letters Patent is hereby corrected as shown below:

TITLE PAGE:

At (73) Assignee: "Soane" should read --Saone--

Signed and Sealed this

Thirteenth Day of February, 2007

JON W. DUDAS
*Director of the United States Patent and Trademark Office*

UNITED STATES PATENT AND TRADEMARK OFFICE

CERTIFICATE OF CORRECTION

PATENT NO. : 7,044,122 B2
APPLICATION NO. : 10/485184
DATED : May 16, 2006
INVENTOR(S) : Laurent Personnettaz et al.

It is certified that error appears in the above-identified patent and that said Letters Patent is hereby corrected as shown below:

TITLE PAGE:

At (73) Assignee: after "Production" enter --Bourgeois--

Signed and Sealed this

Ninth Day of November, 2010

David J. Kappos

David J. Kappos
*Director of the United States Patent and Trademark Office*